US005389232A

United States Patent [19]

Adewuyi et al.

[11] Patent Number: 5,389,232

[45] Date of Patent: Feb. 14, 1995

[54] RISER CRACKING FOR MAXIMUM C3 AND C4 OLEFIN YIELDS

[75] Inventors: Yusuf G. Adewuyi, Chadds Ford, Pa.; Peter M. Adornato, Cherry Hill, N.J.; David L. Johnson, Glenn Mills, Pa.; Gerald L. Teitman, Vienna, Va.

[73] Assignee: Mobil Oil Corporation, Fairfax, Va.

[21] Appl. No.: 877,919

[22] Filed: May 4, 1992

[51] Int. Cl.[6] ..... C10G 13/02

[52] U.S. Cl. ..... 208/120; 208/113; 208/48 Q

[58] Field of Search ..... 208/48 Q, 120

[56] References Cited

U.S. PATENT DOCUMENTS

| | | | |
|---|---|---|---|
| 3,758,403 | 9/1973 | Rosinski et al. | 208/120 |
| 4,764,268 | 8/1988 | Lane | 208/48 Q |
| 4,818,372 | 4/1989 | Mauleon et al. | 208/113 |
| 5,019,239 | 5/1991 | Owen | 208/48 Q |
| 5,043,058 | 8/1991 | Forgac et al. | 208/48 Q |
| 5,087,349 | 2/1992 | Goelzer et al. | 208/113 |

*Primary Examiner*—Helane Myers

*Attorney, Agent, or Firm*—Alexander J. McKillop; Malcolm D. Keen; Richard D. Stone

[57] ABSTRACT

A process for catalytically cracking a heavy feed in a single riser reactor FCC unit, with delayed riser quench and large amounts of shape selective cracking additive is disclosed. The feed is preferably quenched after at least 1 second of riser cracking. The catalyst inventory preferably contains over 3.0 wt % ZSM-5 cystal, in the form of an additive of 12–40% ZSM-5 on an amorphous support. Quenching with recycled LCO is preferred. Delayed quenching, with this catalyst system, produces unexpectedly large amounts of C3/C4 olefins, with little or no increase in coke make.

16 Claims, 1 Drawing Sheet

RISER CRACKING FOR MAXIMUM C3 AND C4 OLEFIN YIELDS

BACKGROUND OF THE INVENTION

1. Field of the Invention

The invention relates to fluidized catalytic cracking.

2. Description of Related Art

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425° C.–600° C., usually 460° C.–560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500° C.–900° C., usually 600° C.–750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking has undergone progressive development since the 1940s. The trend of development of the fluid catalytic cracking (FCC) process has been to all riser cracking and use of zeolite catalysts. A good overview of the importance of the FCC process, and its continuous advancement, is reported in Fluid Catalytic Cracking Report, Amos A. Avidan, Michael Edwards and Hartley Owen, as reported in the Jan. 8, 1990 edition of the Oil & Gas Journal.

Modern catalytic cracking units use active zeolite catalyst to crack the heavy hydrocarbon feed to lighter, more valuable products. Instead of dense bed cracking, with a hydrocarbon residence time of 20–60 seconds, much less contact time is needed. The desired conversion of feed can now be achieved in much less time, and more selectively, in a dilute phase, riser reactor.

The product distribution from modern FCC units is good. The volume and octane number of the gasoline is satisfactory, and the light olefins produced are upgraded via sulfuric or HF alkylation to high quality alkylate.

Unfortunately, refiners are finding it more difficult to make gasoline of sufficient octane and meet new specifications in regard to oxygenates, aromatics and benzene in the fuel. Reduced limits on RVP (Reid Vapor Pressure) and gasoline endpoint reduce the amount of butanes that can be added, further exacerbating the problem. Cost and availability of alkylation capacity make olefin alkylation a less attractive way to make gasoline.

We wanted to squeeze more gasoline and distillate out of FCC processing and change the quality and quantity of the light ends made by the FCC process. We wanted more light olefins, C3 and C4 olefins, but did not want to further reduce the yields of FCC gasoline. We wanted the increased light olefins for use in etherification and alkylation units, but were reluctant to do so at the expense of gasoline yield.

We also had to work within the constraints of existing units, many of which are limited in throughput by regenerator constraints, blower capacity to burn off the coke make associated with the cracking reaction, or too high a temperature in the regenerator.

The trend in modern FCC units is to operating conditions which favor production of large amounts of gasoline having a high octane number and relatively large amounts of light olefins. Unfortunately, the units have been pushed so far in these directions that further improvement is very difficult to achieve. Usually improvements in one area cause problems in another.

Higher riser temperatures, and shorter contact times in the riser reactor increase olefin yields, but also increase production of coke, dry gas and butadiene and reduces gasoline yields. Increased coke make increases temperature in the regenerator and puts more demands on the regenerator air blower. The increased production of dry gas can overload the wet gas compressor and the upper trays of the FCC main column. Increase make of butadiene makes the C4 streams less valuable, and increases acid consumption in downstream alkylation units.

We thought that conventional FCC processing had been pushed to the limit in regard to increasing olefin production, without increasing coke make, dry gas production or reducing gasoline yields inordinately. We knew there was a need for more light olefins, but conventional approaches, primarily directed at maximizing conversion of heavy feeds, had reached their limit.

Using existing technology, anything we did to increase C3/C4 olefin yield caused offsetting penalties in increased coke make, dry gas make or a severe loss of gasoline yield. Some of the conventional approaches will be reviewed below. Those primarily directed at better conversion of heavy will be reviewed first, followed by a review of additives which increase gasoline octane and yields of light olefins.

Heavy Feed Upgrading

In typical FCC units the feeds are charged altogether to the bottom of the riser or the heavier fractions are added into an upper portion of the riser.

In U.S. Pat. No. 4,422,925 Williams et al a low molecular weight feed is charged to the bottom of a riser reactor, and then feeds having the highest tendency to form coke are introduced the uppermost section of the riser and are exposed to the lowest reaction temperature and the lowest catalyst to oil ratios. This gives poor conversion of the worst feeds.

U.S. Pat. No. 4,218,306 Gross et al, assigned to the assignee of the present invention and incorporated by reference, has a similar teaching.

Some units crack heavier feeds with higher temperatures in the base of the riser. They charge the heavy feed to the base of the riser, then quench with a heat sink, such as water or a cycle oil, higher up in the riser. The higher temperatures were believed to improve vaporization, or cause instantaneous thermal cracking of the heaviest molecules into smaller molecules which could be cracked catalytically.

Instantaneous thermal cracking of the heaviest molecules into smaller molecules is taught in U.S. Pat. No. 4,818,372. Cracking a heavy feed (the examples used a hydrotreated resid and a feed with more than 65% by weight boiling above 500° C.) at an unusually high mix temperature, then quenching within one second, preferably less than half a second, was suggested.

Published European Application EP A 0311375 has similar teaching. Heavy feeds were cracked at high temperature in the base of a riser, then quenched. The higher temperatures improved cracking by improving feed vaporization. The C3− yields increased from 9.9 to 11.6 wt % with quenching, while the C4 yields decreased from 10.3 wt % to 9.9 wt %. The data showed that increasing riser top temperature, rather than quenching, was a more effective way of increasing yields of C3 and lighter and C4 material, although the total wet gas make also increased more than 34%.

Octane Additive

Refiners use ZSM-5 as an additive to increase FCC gasoline octane. This usually reduces gasoline yield and increases gas production, large portions of which are C3/C4 olefins.

In U.S. Pat. No. 3,758,403, from 2½ to 10 wt. % ZSM-5 catalyst was added to a conventional cracking catalyst containing 10 percent REY, the remainder being Georgia clay. Examples were given showing use of 1.5, 2.5, 5 and 10 wt. % ZSM-5 added to the conventional cracking catalyst. Gasoline octane increased, and there were increased yields of light olefin, but there was a substantial drop in gasoline yield.

U.S. Pat. No. 4,309,280 taught adding very small amounts of powdered, neat ZSM-5 catalyst, characterized by a particle size below 5 microns. Adding as little as 0.25 wt % ZSM-5 powder to the FCC catalyst inventory increased LPG production 50%. Small amounts of neat powder behaved much like larger amounts of ZSM-5 disposed in larger particles.

A good way to add a modest amount of ZSM-5 to an FCC unit is disclosed in U.S. Pat. No. 4,994,424, incorporated by reference. ZSM-5 additive is added to the equilibrium catalyst in a programmed manner so an immediate boost in octane number, typically ½–2 octane number, is achieved.

U.S. Pat. No. 4,927,523, incorporated by reference, taught a good way to add large amounts of ZSM-5 to a unit without exceeding wet gas compressor limits. Large amounts were added, and cracking severity reduced until the ZSM-5 activity tempered from circulating through the FCC unit for several days.

ZSM-5 additive has been used commercially for almost a decade and is now a well accepted way to increase C3 and C4 olefin yields and gasoline octane at the cost of some loss in gasoline yield.

Commercially refiners use ZSM-5 additive, typically 10–30% ZSM-5 in an amorphous support. Most refiners add enough ZSM-5 to see an increase in gasoline octane of around 1.0 octane numbers (R+M/2), though a few may operate with more than that. Commercial units usually have a few wt % ZSM-5 additive, pure crystal basis, in the equilibrium catalyst.

Although yields of propylene generally increase with increasing concentration of ZSM-5, yields of C4 olefins can decrease when large amounts of ZSM-5 are added. It is believed that most refiners operate with modest amounts of ZSM-5 because the benefits of operating with more ZSM-5 (gasoline octane and C3 olefin yield increase) are not worth the detriments (gasoline yield loss, cost of additive and reduced C4 olefin production). No operation of commercial units with large amounts of additive has ever been reported, e.g., all commercial units are believed to operate with less than 10 wt % additive, usually quite a bit less.

We needed more olefins, and could find no effective way to generate them in the amounts we needed. Quench technology helped increase gasoline yields and octane but had only a limited effect on total yield of C3/C4 olefins, and our pilot plant tests showed quench could decrease production of isobutane more than 10%.

ZSM-5 additive is a proven way of making light olefins, and we were reluctant to give this up but were also concerned about the effect of raising reactor temperatures or raising them in the base of the riser by using quench technology, on the ZSM-5 additive. Elia et al, in "Effect of Operation Conditons on the Behavior of ZSM-5 Addition to a RE-USY FCC Catalyst" Appl Catal 73, 195 (1991) reported that higher temperatures could degrade the effectiveness of ZSM-5 additive. RON gains were relatively insensitive to cracking temperature in the 500° to 520° C. range, but the response of MON to ZSM-5 addition decreased as the temperature increased. Higher temperatures favored formation of C7–C8 aromatics and a smaller increase in C5 and C6 compounds, compared to operation at lower temperatures with ZSM-5 levels from 0 to 3 wt %.

We discovered a way to operate FCC units so yields of C3/C4 olefins could be increased significantly. Using higher reactor temperatures in the base of the riser (riser quench) and unconventional amounts of ZSM-5 additive, we increased yields of C3/C4 olefins by an amount greater than that which could have been obtained practicing either technology alone. We achieved high olefin yields without decreasing yields of valuable iso-butane, and with little or no change in coke make.

BRIEF SUMMARY OF THE INVENTION

Accordingly, the present invention provides a catalytic cracking process for converting a heavy hydrocarbon feed to lighter products comprising: charging a heavy hydrocarbon feed comprising hydrocarbons boiling above 650° F. to a base section of a riser catalytic cracking reactor having a length, said base section, and an upper outlet section; charging a stream of a fluidized solids mixture of hot, regenerated base FCC cracking catalyst and separate particles of shape selective zeolite cracking catalyst additive in an amorphous support from a catalyst regenerator to the base of the riser reactor, said stream containing 7.5 to 35 wt % additive and 90 to 62.5 wt % base FCC catalyst, and wherein the additive contains a concentration of shape selective zeolite such that the solids mixture contains more than 3.0 wt % shape selective zeolite, on a pure shape selective zeolite basis; catalytically cracking said feed at catalytic cracking conditions including a solids:feed weight ratio of a least 4:1, a solids/feed mixture temperature in the base of the riser of 950° to 1100° F.; quenching the solids/feed mixture in at least one quench zone in said riser reactor downstream of the base thereof and at least 10 percent of the length of the riser upstream of said riser outlet, by injecting a quench fluid in an amount sufficient to quench the temperature in the riser at least 10° F. and produce a quenched mixture of solids and hydrocarbon vapor; catalytically cracking in said riser reactor said quenched mixture for a time equal to at least the vapor residence time of the last 10% of the length of said riser to produce a mixture of catalytically cracked products and solids which are discharged from said outlet of said riser reactor; separating said discharged mixture of catalytically cracked products and solids into a cracked product rich vapor phase, which is withdrawn as a product, and a solids rich phase containing spent cracking catalyst and shape selective additive catalyst; stripping said solids in a stripping means at stripping conditions to produce stripped solids containing coke; decoking said stripped solids in a catalyst regeneration means operating at catalyst regeneration conditions to produce a stream of a fluidized solids mixture of hot, regenerated base FCC cracking catalyst and separate particles of shape selective zeolite cracking catalyst additive, which is recycled to the base of said riser reactor.

In another embodiment,the present invention provides a catalytic cracking process for converting a heavy hydrocarbon feed to lighter products comprising; charging a heavy hydrocarbon feed comprising hydrocarbons boiling above 650° F. to a base section of a riser fluidized catalytic cracking (FCC) reactor having a length and including a base section and an upper outlet section; charging a stream of a fluidized solids mixture from a catalyst regenerator to the base of the riser reactor, said mixture comprising: 90 to 60 wt % hot, regenerated base FCC cracking catalyst having a large pore zeolite content, based on fresh makeup large pore cracking catalyst, of at least 25.0 wt % large pore zeolite, and 10 to 30 wt % separate particles of ZSM-5 additive having a ZSM-5 content of at least 12.5 wt % in an amorphous support, and wherein the additive amount and ZSM-5 concentration are sufficient to provide more than 3.0 wt % ZSM-5, on a pure crystal basis of the solids inventory; catalytically cracking said feed at catalytic cracking conditions including a solids: feed weight ratio of a least 4:1, a solids/feed mixture temperature in the base of the riser of 950° to 1100° F.; quenching the solids/feed mixture in at least one quench zone, within said riser reactor downstream of the base thereof and at least 50 percent of the length of the riser upstream of said riser outlet, by injecting a quench fluid selected from the group of catalytically cracked heavy naphtha, light cycle oil and heavy cycle oil, in an amount sufficient to quench the temperature in the riser at least 10° F. and produce a quenched mixture of solids and hydrocarbon vapor; catalytically cracking in said riser reactor said quenched mixture for a time equal to at least the vapor residence time of the last 10% of the length of said riser to produce a mixture of catalytically cracked products and solids which are discharged from said outlet of said riser reactor; separating said discharged mixture of catalytically cracked products and solids into a cracked product rich vapor phase, and a solids rich phase containing spent cracking catalyst and ZSM-5 additive; fractionating said cracked vapor in a fractionation means at fractionation conditions to produce at least one cracked product liquid stream including at least one of a heavy naphtha, a light cycle oil, and a heavy cycle oil and recycling at least a portion of said cracked product liquid stream to said riser reactor as said quench stream; stripping said solids in a stripping means at stripping conditions to produce stripped solids containing coke; decoking said stripped solids in a catalyst regeneration means operating at catalyst regeneration conditions to produce a stream of hot, regenerated base FCC cracking catalyst and ZSM-5 additive which is recycled to the base of said riser reactor, and wherein the amount of ZSM-5 additive, and quench, are sufficient to increase production of C3/C4 light olefins at least 40% and increase coke production less than 10%, as compared to unquenched operation without ZSM-5 additive.

In another embodiment,the present invention provides a catalytic cracking process for converting a heavy hydrocarbon feed to lighter products comprising; charging a distilled, hydrotreated gas oil or vacuum gas oil feed to a base section of a riser fluidized catalytic cracking (FCC) reactor having a length and including a base section and an upper outlet section; charging a stream of a fluidized solids mixture of hot, regenerated base FCC cracking catalyst and separate particles of ZSM-5 additive in an amorphous support from a catalyst regenerator to the base of the riser reactor, said stream containing about 22.5 to 27.5 wt % additive and about 72.5 to 77.5 wt % base FCC catalyst; catalytically cracking said feed at catalytic cracking conditions including a solids: feed weight ratio of a least 4:1, a solids/feed mixture temperature in the base of the riser of 950° to 1100° F.; quenching the solids/feed mixture in at least one quench zone, within said riser reactor downstream of the base thereof 75 percent of the length of the riser upstream of said riser outlet, by injecting a recycled light cycle oil derived from catalytically cracked products, and in an amount equal to 10 to 20 LV % of the fresh feed to quench the temperature in the riser at least 10° F. and produce a quenched mixture of solids and hydrocarbon vapor; catalytically cracking in said riser reactor said quenched mixture for a time equal to at least the vapor residence time of the last 25% of the length of said riser to produce a mixture of catalytically cracked products and solids which are discharged from said outlet of said riser reactor; separating said discharged mixture of catalytically cracked products and solids into a cracked product rich vapor phase, and a solids rich phase containing spent cracking catalyst and ZSM-5 additive; fractionating said cracked vapor in a fractionation means at fractionation conditions to produce a light cycle oil fraction and recycling at least a portion of it to said riser reactor as said quench stream; stripping said solids in a stripping means at stripping conditions to produce stripped solids containing coke; decoking said stripped solids in a catalyst regenerator operating at catalyst regeneration conditions to produce a stream of hot, regenerated base FCC cracking catalyst and ZSM-5 additive which is recycled to the base of said riser reactor, and wherein the amount of ZSM-5 additive, and LCO quench, are sufficient to increase yield of C3/C4 light olefins at least 40%, and increase coke yield less than 10%, as compared to unquenched operation without ZSM-5 additive.

BRIEF DESCRIPTION OF THE DRAWINGS

The FIGURE is a simplified schematic process flow of a preferred embodiment, an FCC unit operating with quench.

DESCRIPTION OF THE PREFERRED EMBODIMENTS

Figure 1:
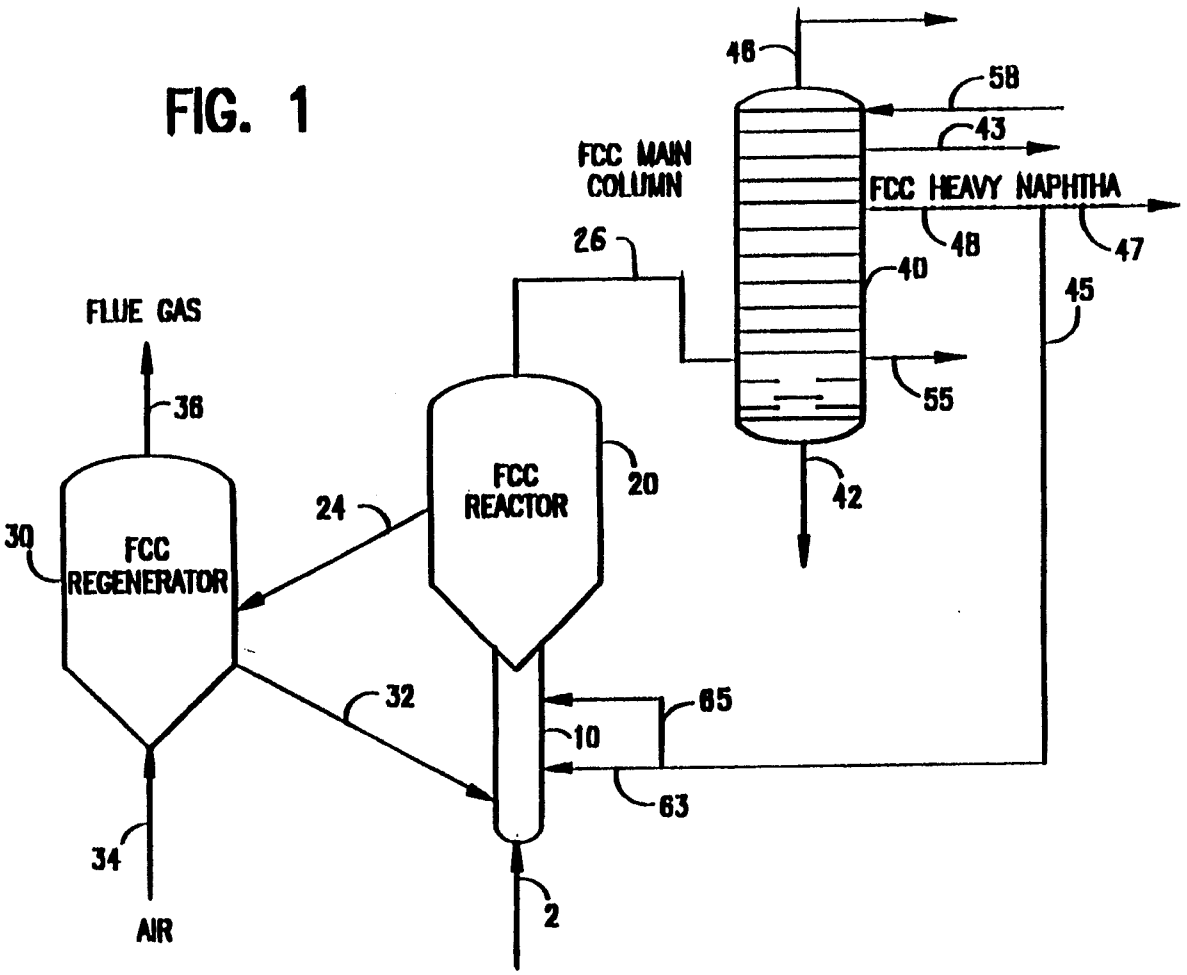

An overview of the process will be presented in a review of the FIGURE, then additional details of the FCC process and the naphtha recracking process will be presented.

The hydrocarbon feed can be a gas oil, a vacuum gas oil fraction, a resid, or vacuum resid or mixture. We prefer to use distilled feeds, or hydrotreated feeds or preferably distilled, hydrotreated feeds, because these are much easier to crack, produce less coke, and deposit less metals on the catalyst. Our process works with any conventional hydrocarbon feed to FCC units, but clean feeds are preferred, to protect our preferred high zeolite cracking catalysts, and large amounts of ZSM-5or equivalent additive.

The FCC unit includes FCC riser 10, FCC reactor 20 (primarily a spent catalyst/cracked product separator, rather than a reactor), regenerator 30, and FCC main column 40.

The feed is charged via line 2 to the base of riser reactor 10. Hot regenerated catalyst flows from regenerator 30 via line 32 to the base of the riser 10.

A quench stream, preferably a recycled light cycle oil or heavy naphtha from line 45, is added to one or more quench points via lines 63 or 65 at various elevations in the riser. The optimum quench point, and number of quench points, can vary based on product demands, unit constraints, and catalyst activity. Because of the large content of shape selective cracking catalyst additive, we prefer to quench high up in the riser, preferably more than ½ way up the riser, and most preferably about 65 to 85% of the way up the riser, with the optimum quench point being around 70 to 80% of the way up the riser in most units. This quench is significantly delayed, compared to conventional quench technology, e.g., as taught in U.S. Pat. No. 4,818,372 which called for quenching within one second or preferably within ½ second or less. We like to quench after at least 1 second of cracking, and preferably after 1.5 or 2.0 seconds of cracking.

Feed and hot catalyst pass up the riser, are quenched, and then are catalytically cracked at a lower temperature in the remainder of the riser. Cracked products and spent catalyst enter FCC reactor 20, where little reaction occurs. Spent catalyst is separated from cracked products by conventional means. Spent catalyst is stripped in a catalyst stripping means within vessel 20, then charged via line 24 to FCC regenerator 30. Regeneration air is added via line 34. Coke is burned from spent catalyst in the regenerator, producing flue gas removed via line 36 and hot regenerated catalyst recycled via line 32 to the base of riser reactor 10.

Hot cracked product withdrawn from vessel 20 passes via line 26 to the base of the FCC main column 40, which operates conventionally. Trays or packing fractionate the cracked product vapor into a main column bottom stream 42, sometimes called a slurry oil, one or more cycle oil products, such as a light cycle oil (LCO) or heavy cycle oil (HCO) product withdrawn via line 55, a heavy naphtha stream withdrawn via line 48, a light naphtha stream withdrawn via line 43, and an overhead vapor stream withdrawn via line 46. Light liquid reflux returns to the column via line 58.

The heavy naphtha fraction withdrawn via line 48 may be removed as a product via line 47, but preferably some of the FCC heavy naphtha and/or some of the light cycle oil is recycled via line 45 to one or more quench points in the FCC riser reactor.

Use of FCC heavy naphtha quench brings about some unexpected upgrading of the heavy naphtha. The heavy naphtha is desulfurized some and converted to lighter gasoline, but dry gas make is minimal.

Use of LCO quench minimizes production of LCO, and helps increase gasoline yields. In many FCC fractionators, flooding is less likely if a heavy quench such as LCO, or to a lesser extent heavy naphtha, is used rather than a lighter material such as FCC light naphtha or a C5/C6 stream. LCO quench also allows heat to be removed from the process at a higher temperature, e.g., produce higher pressure steam.

There are myriad variations in FCC processing which may be used, from different types of regenerators, different reactor designs, etc., but the underlying unit operations (cracking reaction, catalyst regeneration, product fractionation) will always be present.

DESCRIPTION OF THE PREFERRED EMBODIMENTS

Riser Cracking Conditions—Pre Quench

The conditions in the base of the riser can be more or less conventional, i.e., the somewhat higher temperatures, and higher cat:oil ratios taught in U.S. Pat. No. 4,818,372, incorporated herein by reference, may be used herein. These conditions are very similar to conventional FCC riser cracking condition, but about 10° to 50° F. hotter, and those skilled in the cracking arts can readily achieve such conditions.

In general, the mix temperature at the base of the riser will be from 950°-1100° F., and catalyst:oil ratios will range from 1:1 to 10:1.

Efficient cracking in the riser requires efficient feed atomization. Atomizing feed nozzle(s) which produce droplets of oil having an average particle size below 2000 microns, preferably below 1000 microns, and most preferably below 500 microns, should be used. Our process will work well with feed nozzles generating droplets having an average particle size of 400–600 microns. Even smaller droplet sizes, below 200 microns, or below 100 microns, are preferred but difficult to achieve in commercial units.

Nozzle exit velocities above 50 fps, preferably above 100 fps and most preferably above 200 fps, should be used. The nozzles preferably vaporize the distilled feed in the riser within less than 10 meters of travel, and more preferably within 1 to 5 meters of riser travel or even less.

Regardless of the nozzle velocity or droplet size, it is beneficial if feed is vaporized within ½ second, preferably within 0.2 seconds of vapor residence time, and most preferably within 0.1 seconds of vapor residence time. Rapid feed vaporization promotes high temperature, catalytic cracking in the base of our riser reactor of a fully vaporized feed.

Riser Top Temperature

Although conditions at the base of the riser are more severe than those associated with conventional FCC operations, the FCC unit at the top of the riser, and downstream of the riser, can operate conventionally. It will frequently be beneficial to operate with somewhat lower than normal riser top temperatures. Riser top temperatures of 900–1050, preferably 950 to 1025 F., will be satisfactory in many instances.

Quench

We believe part of the reason our process works so well is promotion of catalytic cracking in the base of the riser with high temperatures. Quenching preferably occurs only after the catalyst loses most of its initial activity due to coke formation. Quenching of this deactivated catalyst reduces catalytic cracking and also reduces thermal cracking.

Catalytic cracking predominates in the base of the riser, due to the active large pore cracking catalyst, especially the shape selective additive such as ZSM-5 and high temperature. The large pore catalyst deactivates rapidly, but the ZSM-5 does not. Either quick or delayed, quenching can be used in the riser. There are benefits and detriments to each approach. Each approach will be briefly reviewed as each represents maximum and minimum conditions in a spectrum of quench operations.

Quick Quenching

When large amounts of quench can be tolerated, quenching may occur relatively quickly in the riser, within less than a second or even within 0.5 seconds or less. By relatively large amounts of quench, we mean that sufficient quench fluid is added to reduce temperatures from 10° to 100° F., and preferably by 20° to 75° F., presuming all streams are well mixed and that quench is instantaneous.

The benefit of using large amounts of quench is that the maximum promotion of large pore catalytic cracking will be achieved while the catalyst is still highly active in the base of the riser. The benefits of short residence time riser cracking can be achieved in a conventional FCC unit, in the lower 10–50% of the riser. The upper portions of the riser can be largely eliminated with large amounts of quench, because all reactions, both thermal and catalytic, will be suppressed downstream of the quench point.

There are several drawbacks. Large amounts of water quench, on the order of 10–15 wt % water, produce large amounts of steam, which increases the pressure drop across the riser, and the vapor traffic in the main column, and an increase in sour water production.

Use of recycled liquid hydrocarbon streams unloads to some extent the wet gas compressor, but large amounts of naphtha or LCO can load up the riser some and can flood the main column.

Large amounts of quench can suppress ZSM-5, or other shape selective additive, cracking higher up in the riser. We prefer to maximize shape selective cracking, rather than minimize it. One of the advantages of high silica, shape selective additives is that they do not coke or deactivate rapidly in the riser. In the early days of experimenting with ZSM-5 additive, particles of ZSM-5 mixed in with equilibrium cracking catalyst could be spotted after an experiment, because they were still light colored, whereas the equilibrium catalyst was dark colored with coke.

Quick quenching suppresses all reactions, thermal, large pore cracking and reactions promoted by ZSM-5, which in our process is present in large amounts, so we prefer to let the reaction continue at high temperature in the riser for a long time, for "too long" based on conventional wisdom ZSM-5 activity can be maximized with this delayed quenching.

Delayed Quenching

When small amounts of quench fluid are used, midway up the riser, or nearer the riser outlet, much less quench is needed. Catalytic reactions will be promoted throughout a much greater distance in the riser reactor, in competition with increased thermal reactions upstream of the quench point.

Quenching with modest amounts of quench fluid will usually occur after at least a second of vapor residence time in the base of the riser, and preferably after 1.5 seconds of residence time, and most preferably after 2.0 seconds of residence time.

Rather than refer to vapor residence time, which varies from unit to unit and is difficult to calculate, quenching at the following fractional riser locations may be considered. In general, we believe that quenching should occur at least ½ way up the riser, and preferably around 6/10 to 9/10 of the way up the riser. Quenching about ¾ up the riser, or later, will be optimum in many installations.

It is important to quench well upstream of the riser outlet. Quenching at the riser outlet, or within 10% of the distance to the riser outlet, will suppress post-riser thermal cracking, but not in riser thermal cracking. We prefer to use closed cyclones to suppress post-riser thermal cracking, and use quench within the riser to suppress riser thermal cracking.

Quench Fluid

All quench fluids will increase conversion of feed, and increase both gasoline yield and octane. Either conventional, generally inert quench fluids, or mildly or highly reactive quench fluids can be used.

Conventional, relatively inert quench fluids include cold solids, water, steam, or inert vaporizable liquids, such as light cycle oil, heavy cycle oil, slurry oils, or other aromatic rich streams, may be used. All such quench fluids will remove heat. Preferably liquids are used so more heat can be removed from a given weight of fluid added.

Use of a mildly reactive quench liquid, FCC heavy naphtha, is preferred, because all the benefits of quench technology are achieved and some upgrading of the heavy naphtha is achieved.

Heavy Naphtha Quench

Heavy naphtha is usually that portion of the FCC cracked product having an initial boiling point from 220° to 325° F., a 5% boiling point of 250° to 300°, a 95% boiling point from 400 to 500 and an end boiling point from about 425° F. to 525° F. The heavy naphtha is that fraction intermediate the FCC light naphtha (C5+ to the end point for light naphtha) and light cycle oil. Considerable variation in boiling ranges of all these materials is possible, due both to local product specifications and fractionator constraints. There is usually considerable overlap between the end point of the heavy naphtha and the initial boiling point of the light cycle oil, because of imperfect fractionation.

Heavy naphtha quench is an especially preferred quench fluid. This material is almost always available downstream of an FCC unit. Its use does not add to sour water production. Its use as a quench material increases FCC conversion, and increases gasoline octane. It also, quite unexpectedly, reduces gasoline sulfur content to some extent while increasing dry gas production little, if any.

It was surprising to us how beneficial heavy naphtha quench could be in an FCC, especially so because FCC heavy naphtha is a troublesome product. Although valuable because it has a relatively high octane and can be added to the refinery gasoline pool, its use in the gasoline blending pool causes problems. FCC heavy naphtha adds a disproportionate amount of sulfur to the gasoline. Many FCC units must send all or a portion of the heavy FCC naphtha to a hydrotreater, to remove sulfur, and most of the olefins, and therefore much of the octane value in the heavy gasoline.

Heavy naphtha quench may be used in an amount equal to about 2.5 to 25 wt % of the fresh feed, preferably about 5 to 15 wt %.

When FCC heavy naphtha is the quench fluid, the mid point, and the 90% point, of a finished gasoline product made from a blend of FCC light naphtha, and hydrotreated heavy naphtha, can usually be reduced from 5° to 10° F. or more. The change in boiling range is believed primarily due to enhanced cracking of fresh feed, but some cracking or conversion of the FCC heavy naphtha quench material is also achieved.

Light Cycle Oil Quench

Light cycle oil or LCO shares many of the advantages of heavy naphtha as a quench fluid. It is always available from the FCC main column, does not increase sour water production, and produces more light product at the expense of LCO yield.

The boiling range of LCO will usually be from 300° to 750° F., preferably from 400° to 700° F., and most preferably from 450° to 650° F.

EQUILIBRIUM CATALYST ACTIVITY

Conventional FCC catalyst, i.e., the sort of equilibrium catalyst that is present in most FCC units, can be used herein. Highly active catalysts, with high zeolite contents are preferred. The process of the present invention will make any FCC reactor using any conventional cracking catalyst work better, but significantly improved results can be achieved by using an unusually active catalyst.

Catalyst activity, both initial and with increasing amounts of coke, plays an important role in determining the optimum quench point location. Catalysts with high large pore zeolite contents, more than 20 wt % zeolite, have significant activity despite significant coke loading, and retain good gasoline selectivity as well.

Units operating with amorphous catalysts, or those catalysts with low zeolite content, or with a catalyst inventory that has been damaged by feed contaminants, will rapidly lose catalyst activity with coke deposition. For these units, the optimum quench point, as far as large pore cracking catalyst activity, will be closer to the feed point, and quench in general will not be as beneficial.

Thus while our process can operate with conventional zeolite catalyst inventories, and even with an inventory of amorphous catalyst, we prefer to operate with catalyst having an unusually high zeolite content, and unusually high activity. Large pore zeolite contents of the fresh makeup catalyst, exclusive of any additive catalyst, of 10 to 80 wt % are suitable, with 30 to 60% preferred, and 35 to 55 wt % considered optimum.

Some of the FCC catalyst stays in the unit for months or potentially for years. Exposure to high temperature and steam causes considerable loss of crystallinity in zeolites in the FCC process, so the equilibrium catalyst will have a lower zeolite content than the fresh makeup catalyst. Because of the difficulty in calculating the actual large pore zeolite content, it is customary in many refineries to refer to the zeolite content of the equilibrium catalyst as, e.g., 25 wt %, but such references are usually to the zeolite content of the fresh makeup catalyst rather than to the zeolite content of the equilibrium catalyst.

Catalyst activities should be at least 55 MAT, more preferably at least 60 to 65 MAT, and most preferably above 70 or even 75 MAT. The MAT test is well known, and more details of it may be found in ASTM test method D3907, which is incorporated by reference.

THERMAL REACTIONS

The extended residence time in the riser, at higher temperatures, will lead to increased thermal conversion. This is good and bad. Thermal cracking produces olefinic (and highly reactive) gasoline of good octane number, but usually in poor yield. Thermal cracking of light ends of the feed, and re-cracking of cracked products, is especially bad. We prefer to reduce the amount of thermal cracking that occurs and always force catalytic cracking to be the dominant reaction in the riser.

We can tolerate a significant amount of thermal cracking, caused by, e.g., quenching more than ½ way up the riser, because we operate with large amounts of shape selective cracking catalyst additive. These additives retain activity much better than the large pore zeolite catalyst in the riser.

SHAPE SELECTIVE ZEOLITE

Any zeolite having a constraint index of 1–12 can be used herein. Details of the Constraint Index test procedures are provided in J. Catalysis 67, 218–222 (1981) and in U.S. Pat. No. 4,711,710 Chen et al, which are incorporated by reference.

Preferred shape selective zeolites are exemplified by ZSM-5, ZSM-11, ZSM-12, ZSM-23, ZSM-35, ZSM-38, ZSM-48, ZSM-57 and similar materials.

ZSM-5 is described in U.S. Pat. No. 3,702,886, U.S. Reissue 29,948 and in U.S. Pat. No. 4,061,724 (describing a high silica ZSM-5 as "silicalite").

ZSM-11 is described in U.S. Pat. No. 3,709,979.
ZSM-12 is described in U.S. Pat. No. 3,832,449.
ZSM-23 is described in U.S. Pat. No. 4,076,842.
ZSM-35 is described in U.S. Pat. No. 4,016,245.
ZSM-38 is described in U.S. Pat. No. 4,046,859.
ZSM-48 is described in U.S. Pat. No. 4,397,827.
ZSM-57 is described in U.S. Pat. No. 4,873,067.
These patents are incorporated herein by reference.

Preferably relatively high silica shape selective zeolites are used, i.e., with a silica/alumina ratio above 20/1, and more preferably with a ratio of 70/1, 100/1, 500/1 or even higher.

ZSM-5 zeolite is preferred, because it is a well known and a proven zeolite additive for use in catalytic cracking units.

Quite a lot of work has been done on making zeolites, such as ZSM-5, with different materials, ranging from all silica to materials containing silica and some other tetravalent metal such as boron, iron, gallium, etc. In lieu of, or in addition to, being incorporated into the zeolite framework, these and other catalytically active elements can also be deposited upon the zeolite by any suitable procedure, e.g., impregnation.

As used herein a named zeolite is defined by its crystal structure. The term ZSM-5 refers to a material which has substantially the same crystal structure as shown in U.S. Pat. No. 3,702,886. Substitution of different cations, or changing the silica/alumina, or silica/boron ratio, may result in minor modifications of the X-ray diffraction patterns of the crystalline material so produced, but it is still ZSM-5, and contemplated for use herein.

ADDITIVE CATALYSTS

The shape selective zeolite is preferably used in the form of a separate additive catalyst, rather than mixed in with the large pore cracking catalyst during manufacture thereof. Use of a separate additive allows a refiner to use any conventional cracking catalyst (there are more than 100 types of cracking catalyst available in the U.S., more types of catalyst than there are cracking units in the U.S.) with any amount of shape selective zeolite additive.

We prefer to use unusually large amounts of additive. More than 7.5 wt % of the catalyst inventory should be shape selective additive catalyst. Preferably 10, 12.5, 15, 20, 25, 30 wt % or more of the circulating catalyst inventory is an additive containing shape selective zeolite catalyst.

On a pure crystal basis, the circulating inventory of cracking catalyst preferably should contain at least about 2.0 wt % shape selective zeolite, and preferably contains more than 3.0 wt % ZSM-5, most preferably from 3.5 wt % ZSM-5 to in excess of 4.0 wt % ZSM-5, or other shape selective zeolite.

The use of additive catalyst permits adjustment of ZSM-5 level relatively independently of equillibrium catalyst properties. The additive catalyst can contain large or small amounts of ZSM-5, or other shape selective zeolite.

The shape selective zeolite may be present in the additive in the amount of 10 to 95% or higher, although usually the difficulties of preparing a binder free additive are not worth the cost and reduced attrition resistance associated with such materials. Preferably the additive material contains 10 to 65 wt % shape selective zeolite, and most preferably 12 to 40 wt % shape selective zeolite.

Quite a lot of work has been done on formulating and optimizing additive compositions. It will be briefly reviewed.

U.S. Pat. No. 4,826,793, Velten and Demmel, incorporated by reference, teaches ZSM-5 additives for FCC use with 20, 40 or 60 wt % ZSM-5 in an attrition resistant matrix.

ZSM-5 may be stabilized with phosphorous or be in a phosphorous containing matrix. Phosphorous stabilization is well known in the art, and more details of the technique may be taken from the following patents.

U.S. Pat. No. 3,911,041, Kaeding et al, which is incorporated by reference, teaches conversion of methanol and ethers over phosphorous stabilized zeolites.

U.S. Pat. No. 3,972,832, Butter et al, which is incorporated by reference, teaches and claims a composition of matter of a phosphorus containing, shape selective zeolite having at least 0.78 wt % phosphorus incorporated with the crystal structure.

U.S. Pat. No. 4,044,065, Butter et al, a Division of '832, claims conversion of aliphatics over phosphorus containing shape selective zeolites.

U.S. Pat. Nos. 4,356,338 and 4,423,266, Young, which are incorporated by reference, teach decreasing catalyst coking, and extending catalyst life, by pretreatment of the catalyst with steam and/or a phosphorus-containing compound. P-ZSM-5/Al203 has a much reduced coking rate, as compared to H-ZSM-5/Al203.

U.S. Pat. No. 4,590,321, Chu, which is incorporated by reference, claims conversion of feeds comprising C2 to C12 alkanes or alkenes at 200 to 700 C. over a phosphorus stabilized zeolite made by impregnating with phosphate ions, then calcining to convert phosphate ions to an oxide of phosphorus.

U.S. Pat. No. 4,454,241 teaches low sodium, phosphorus treated zeolite Y cracking catalyst.

Good ZSM-5 additives are available commercially from Intercat (Z-Cat+) and from Davison (Additive O).

When the catalyst inventory contains large amounts of ZSM-5, the optimum quench point will shift closer to the riser outlet, because the ZSM-5 retains catalytic activity long after the large pore cracking catalyst has lost most of its activity.

SHAPE SELECTIVE ZEOLITE ADDITION

Any conventional method of adding additive zeolite to the equilibrium catalyst can be used. The "slugging" addition method of U.S. Pat. No. 4,927,523 may be used, or the methods disclosed in U.S. Pat. No. 4,927,526 or U.S. Pat. No. 4,994,173. All of these patents relating to additon of additives are incorporated by reference.

FEEDSTOCK

Any conventional cracking unit feed may continue to be used as feed to the FCC unit during the practice of the present invention. The octane number response of different feeds to ZSM-5 catalyst may be different.

EXAMPLES

A series of tests were conducted in a circulating FCC pilot plant on a hydrotreated gas oil feed. The pilot plant unit was not a heat balanced unit, but is considered a reliable predictor of what will happen in commercial FCC units.

Experiments were conducted for a base catalyst without ZSM-5, with and without riser quench. The quench fluid was light cycle oil, injected at a distance 75% from the base of the riser, injected in an amount equal to 15 vol % of the fresh feed. The total residence time in the riser reactor was 3 seconds, and the LCO quench injection occurred after 2.2 seconds of riser residence time. The experiments were then duplicated after replacing 25% of the base catalyst with an additive catalyst containing ZSM-5.

Details of the feed, equilibrium catalyst and additive catalyst are reported below, followed by a table summarizing the experimental results.

The test was conducted at 35 psig pressure, and a Cat:Oil ratio of 6.4. The catalyst: feed mix temperature in the base of the riser was 1030° F. When quench was used, it reduced temperatures about 15° to 20° F. The riser top temperature was 960° F. The feed was a hydrotreated feed. A light cycle oil, LCO, quench was used which was believed to be relatively inert.

| FEED STOCK ANALYSIS: | |
|---|---|
| Density @ 25° C., g/cc | 0.9024 |
| Density @ 70° C., g/cc | 0.8731 |
| API Gravity | 24.0 |
| KV @ 40° C., cS | 18.97 |
| KV @ 100° C., cS | 3.50 |
| Pour Point, °F. | 25 |
| Refractive Index @ 20° C. | 1.5009 |
| Refractive Index @ 70° C. | 1.4817 |
| Molecular Weight | 283 |
| Distillation D2887, °F. | |
| IBP | 365 |
| 10 vol % | 495 |
| 30 vol % | 604 |
| 50 vol % | 706 |
| 70 vol % | 801 |
| 90 vol % | 905 |
| EP | 1022 |
| Distillation D1160, °F. | |
| IBP | 393 |
| 10 vol % | 504 |
| 30 vol % | 598 |
| 50 vol % | 700 |
| 70 vol % | 781 |
| 90 vol % | 880 |
| Composition Analysis | |

-continued

| | |
|---|---|
| Carbon, wt % | 87.0 |
| Hydrogen, wt % | 12.7 |
| Total Nitrogen, wt % | 0.15 |
| Basic Nitrogen, ppm | 380 |
| Sulfur, wt % | 0.048 |
| CCR, wt % | 0.01 |
| $C_A$ | NA |
| Aniline Point, °F. | 152 |
| Bromine Number | 2.17 |
| Paraffins, wt % | 12.6 |
| Naphthenes, vol % | 47.1 |
| Aromatics, vol % | 40.3 |
| 650° F.-, wt % | 38.7 |

CATALYST PROPERTIES

| | E-CAT | ADDITIVE |
|---|---|---|
| Density, g/cc | | |
| Packed | — | 0.82 |
| Loose | 0.93 | 0.74 |
| Real | — | 2.41 |
| Particle | — | 1.33 |
| Pore Volume, cc/g | — | 0.34 |
| Surface Area, M2/g | 111 | 58 |
| REY Crystallinity, wt % | 10 | — |
| Unit Cell Size, Ang. | 24.35 | — |
| Alumina, wt % | — | 34.0 |
| Silica, wt % | — | 56.2 |
| Nickel, ppm | 160 | 89 |
| Vanadium, ppm | 180 | 100 |
| Iron, ppm | 5100 | 7200 |
| Copper, ppm | 17 | 29 |
| Lead, ppm | <12 | — |
| Sulfur, ppm | 200 | — |
| Sodium, ppm | 2500 | 1420 |
| Nitrogen, ppm | 23 | — |
| Phosphorus, wt % | — | 2.7 |
| Rare Earth, wt % | 3.2 | 0.0 |

EXPERIMENTAL RESULTS

| | | | | |
|---|---|---|---|---|
| wt % ZSM-5 Added | 0 | 0 | 25 | 25 |
| LV % LCO Quench | 0 | 15 | 0 | 15 |
| Riser Base F | 1002 | 1042 | 1022 | 1030 |
| Cat:Oil wt:wt | 5.8 | 7.0 | 5.4 | 6.4 |
| Yields, % wt (LV %) | | | | |
| $C_2^-$ | 1.6 | 1.9 | 1.9 | 2.6 |
| $C_3$ | 1.4 (2.5) | 1.2 (2.1) | 1.6 (2.9) | 1.7 (3.0) |
| $C_3^=$ | 3.2 (5.6) | 3.6 (6.2) | 4.9 (8.5) | 5.8 (10.2) |
| n-$C_4$ | 1.1 (1.7) | 0.9 (1.4) | 1.0 (1.6) | 1.0 (1.5) |
| i-$C_4$ | 3.7 (6.0) | 3.2 (5.2) | 4.0 (6.7) | 4.1 (6.7) |
| $C_4^=$ | 4.1 (6.1) | 4.3 (6.5) | 4.5 (6.6) | 4.9 (7.3) |
| Gasoline | 54.6 (64.8) | 56.5 (66.9) | 49.2 (58.2) | 51.5 (60.9) |
| LCO | 25.7 (24.9) | 23.7 (22.6) | 28.0 (26.9) | 24.2 (23.0) |
| MCB | 2.0 (1.7) | 1.6 (1.3) | 2.9 (2.6) | 1.6 (1.5) |
| Coke | 2.6 | 3.1 | 2.0 | 2.6 |
| Conversion | 72.3 (73.4) | 74.7 (76.1) | 69.1 (70.5) | 74.2 (75.5) |
| LV % C3/C4= | 11.7 | 12.7 | 15.1 | 17.5 |
| Gasoline LV % | 64.8 | 66.9 | 58.2 | 60.9 |

DISCUSSION

The tests show just how much propylene (10.2 LV %) and C4 olefin (7.3 LV %) can be produced from the feed, while retaining production of 60.9 LV % gasoline. The total liquid yield, including propane as a liquid, is 114.1 LV % of the fresh feed. The C3/C4 olefin fraction represents 17.5 LV % of the fresh feed, which gives a refiner extraordinary flexibility in regards to alkylation or etherification of this material to produce reformulated fuels to meet new legislative demands.

The results show synergistic yields of light olefins when the catalyst inventory contains large amounts of ZSM-5, and the riser is quenched. We do not know why we obtain larger yields of C3 and C4 olefins than could have been predicted from adding up the yield deltas due to practice of either technology alone. If anything, we easily could have predicted the opposite.

The higher temperatures associated with quench technology would not be expected to work so well with large amounts of ZSM-5, at least not based on Elia et al's work. Elia et al showed high temperatures favor formation of C7–C8 aromatics, and a smaller increase in C5 and C6 compounds, compared to operation at lower temperatures, with ZSM-5 levels from 0 to 3 wt %.

These results are of course dependent on the feedstock, and to a lesser extent on the properties of the equilibrium catalyst, but similar benefits will be seen with other feeds, and in commercial units.

The process of the present invention requires an unusual operation of the FCC unit. We use unprecedented amounts of ZSM-5 additive, and quench very late in the riser. These unusual conditions and unprecedented amounts of ZSM-5 produce a higher yield of C3 and C4 olefins than could have been predicted based on either operation alone.

The process of the present invention provides refiners with the ability to produce reformulated fuels and/or substantially increase propylene and butylene yields while minimizing gasoline yield loss.

What we claim is:

1. A catalytic cracking process for converting a heavy hydrocarbon feed to lighter products comprising;

a. charging a heavy hydrocarbon feed comprising hydrocarbons boiling above 650° F. to a base section of a riser catalytic cracking reactor having a length, said base section, and an upper outlet section;

b. charging a stream of a fluidized solids mixture of hot, regenerated base FCC cracking catalyst and separate particles of shape selective zeolite cracking catalyst additive in a support from a catalyst regenerator to the base of the riser reactor, said stream containing 5 to 35 wt % additive and 95 to 62.5 wt % base FCC catalyst, and wherein the additive contains a concentration of shape selective zeolite such that the solids mixture contains more than 3.0 wt % shape selective zeolite, on a pure shape selective zeolite basis;

c. catalytically cracking said feed at catalytic cracking conditions including a solids: feed weight ratio of a least 4:1, a solids/feed mixture temperature in the base of the riser of 950° to 1100° F.;

d. quenching the solids/feed mixture in at least one quench zone in said riser reactor downstream of the base thereof and at least 10 percent of the length of the riser upstream of said riser outlet, by injecting a quench fluid in an amount sufficient to quench the temperature in the riser at least 10° F. and produce a quenched mixture of solids and hydrocarbon vapor;

e. catalytically cracking in said riser reactor said quenched mixture for a time equal to at least the vapor residence time of the last 10% of the length of said riser to produce a mixture of catalytically cracked products and solids which are discharged from said outlet of said riser reactor;

f. separating said discharged mixture of catalytically cracked products and solids into a cracked product rich vapor phase, which is withdrawn as a product, and a solids rich phase containing spent cracking catalyst and shape selective additive catalyst;

g. stripping said solids in a stripping means at stripping conditions to produce stripped solids containing coke;

h. decoking said stripped solids in a catalyst regeneration means operating at catalyst regeneration conditions to produce a stream of a fluidized solids mixture of hot, regenerated base FCC cracking catalyst and separate particles of shape selective zeolite cracking catalyst additive, which is recycled to the base of said riser reactor.

2. The process of claim 1 wherein said feed is a gas oil or vacuum gas oil or mixture thereof, and is vaporized within 0.2 seconds in the riser reactor.

3. The process of claim 1 wherein said feed is catalytically cracked in said riser for at least 1 second of vapor residence time before quench.

4. The process of claim 1 wherein said quench fluid is selected from the group of water, steam, and recycled catalytically cracked products.

5. The process of claim 1 wherein said quench fluid is recycled heavy naphtha or light cycle oil or a mixture thereof.

6. The process of claim 1 wherein the quench fluid quenches the mixture in the riser 10° to 100° F.

7. The process of claim 1 wherein the shape selective zeolite has a silica:alumina ratio above 12 and a Constraint Index of 1–12.

8. The process of claim 1 wherein the shape selective zeolite is selected from the group of ZSM-5, ZSM-11, ZSM-12, ZSM-23, ZSM-35, ZSM-38, ZSM-48 and ZSM-57.

9. The process of claim 1 wherein the shape selective zeolite is selected from the group of ZSM-5 and ZSM-11, the zeolite is present in the additive in an amount equal to 12.5 to 50 wt % of the additive particle, and the additive particles make up 7.5 to 25 wt % of the solids mixture and the base FCC catalyst makes up 92.5 to 70 wt % of the solid mixture.

10. A catalytic cracking process for converting a heavy hydrocarbon feed to lighter products comprising;

a. charging a heavy hydrocarbon feed comprising hydrocarbons boiling above 650° F. to a base section of a riser fluidized catalytic cracking (FCC) reactor having a length and including a base section and an upper outlet section;

b. charging a stream of a fluidized solids mixture from a catalyst regenerator to the base of the riser reactor, said mixture comprising:

90 to 60 wt % hot, regenerated base FCC cracking catalyst having a large pore zeolite content, based on fresh makeup large pore cracking catalyst, of at least 25.0 wt % large pore zeolite, and 10 to 30 wt % separate particles of ZSM-5 additive having a ZSM-5 content of at least 12.5 wt % in an amorphous support, and wherein the additive amount and ZSM-5 concentration are sufficient to provide more than 3.0 wt % ZSM-5, on a pure crystal basis of the solids inventory, c. catalytically cracking said feed at catalytic cracking conditions including a solids: feed weight ratio of a least 4:1, and a solids/feed mixture temperature in the base of the riser of 950° to 1100° F.;

d. quenching the solids/feed mixture in at least one quench zone, within said riser reactor downstream of the base thereof and at least 50 percent of the length of the riser upstream of said riser outlet, by injecting a quench fluid selected from the group of catalytically cracked heavy naphtha, light cycle oil and heavy cycle oil, in an amount sufficient to quench the temperature in the riser at least 10° F. and produce a quenched mixture of solids and hydrocarbon vapor;

e. catalytically cracking in said riser reactor said quenched mixture for a time equal to at least the vapor residence time of the last 10% of the length of said riser to produce a mixture of catalytically cracked products and solids which are discharged from said outlet of said riser reactor;

f. separating said discharged mixture of catalytically cracked products and solids into a cracked product rich vapor phase, and a solids rich phase containing spent cracking catalyst and ZSM-5 additive;

g. fractionating said cracked vapor in a fractionation means at fractionation conditions to produce at least one cracked product liquid stream including at least one of a heavy naphtha, a light cycle oil, and a heavy cycle oil and recycling at least a portion of said cracked product liquid stream to said riser reactor as said quench stream;

h. stripping said solids in a stripping means at stripping conditions to produce stripped solids containing coke;

i. decoking said stripped solids in a catalyst regeneration means operating at catalyst regeneration conditions to produce a stream of hot, regenerated base FCC cracking catalyst and ZSM-5 additive which is recycled to the base of said riser reactor, and wherein the amount of ZSM-5 additive, and quench, are sufficient to increase production of C3/C4 light olefins at least 40%, and increase coke production less than 10%, as compared to unquenched operation without ZSM-5 additive.

11. The process of claim 10 wherein said feed is a gas oil or vacuum gas oil or mixture thereof, and is vaporized within 0.1 seconds in the base of the riser reactor.

12. The process of claim 10 wherein said feed is catalytically cracked in said riser for at least 1 second of vapor residence time before quench, and wherein said quench point is at least ¾ of the way up the height of the riser.

13. The process of claim 10 wherein said quench fluid is light cycle oil.

14. The process of claim 10 wherein the quench fluid is used in an amount equal to 10 to 20 LV % of the fresh feed.

15. The process of claim 10 wherein the ZSM-5 additive is selected from the group of PZSM-5, ZSM-5 having a silica: alumina ratio above 200:1, and ZSM-5 having a 25:1 to 75:1 silica:alumina ratio, and wherein the ZSM-5 is 15 to 40 wt % of the additive.

16. A catalytic cracking process for converting a heavy hydrocarbon feed to lighter products comprising;

a. charging a distilled, hydrotreated gas oil or vacuum gas oil feed to a base section of a riser fluidized catalytic cracking (FCC) reactor having a length and including a base section and an upper outlet section;

b. charging a stream of a fluidized solids mixture of hot, regenerated base FCC cracking catalyst and separate particles of ZSM-5 additive in an amorphous support from a catalyst regenerator to the base of the riser reactor, said stream containing about 22.5 to 27.5 wt % additive and about 72.5 to 77.5 wt % base FCC catalyst;

c. catalytically cracking said feed at catalytic cracking conditions including a solids:feed weight ratio of a least 4:1, a solids/feed mixture temperature in the base of the riser of 950° to 1100° F.;

d. quenching the solids/feed mixture in at least one quench zone, within 65 to 85 percent of the length of the riser downstream of said riser base, by injecting a recycled light cycle oil derived from catalytically cracked products in an amount equal to 10 to 20 LV % of the fresh feed to quench the temperature in the riser at least 10° F. and produce a quenched mixture of solids and hydrocarbon vapor;

e. catalytically cracking in said riser reactor said quenched mixture for a time equal to at least the vapor residence time of the last 15% of the length of said riser to produce a mixture of catalytically cracked products and solids which are discharged from said outlet of said riser reactor;

f. separating said discharged mixture of catalytically cracked products and solids into a cracked product rich vapor phase, and a solids rich phase containing spent cracking catalyst and ZSM-5 additive;

g. fractionating said cracked vapor in a fractionation means at fractionation conditions to produce a light cycle oil fraction and recycling at least a portion of it to said riser reactor as said quench stream;

h. stripping said solids in a stripping means at stripping conditions to produce stripped solids containing coke;

i. decoking said stripped solids in a catalyst regenerator operating at catalyst regeneration conditions to produce a stream of hot, regenerated base FCC cracking catalyst and ZSM-5 additive which is recycled to the base of said riser reactor, and wherein the amount of ZSM-5 additive, and LCO quench, are sufficient to increase yield of C3/C4 light olefins at least 40%, and increase coke yield less than 10%, as compared to unquenched operation without ZSM-5 additive.

* * * * *